US008808471B2

(12) United States Patent
Wright et al.

(10) Patent No.: US 8,808,471 B2
(45) Date of Patent: Aug. 19, 2014

(54) MARTENSITIC STAINLESS STEEL STRENGTHENED BY COPPER-NUCLEATED NITRIDE PRECIPITATES

(75) Inventors: James A. Wright, Wilmette, IL (US); Gregory B. Olson, Riverwoods, IL (US); Weijia Tang, Wilmette, IL (US)

(73) Assignee: QuesTek Innovations LLC, Evanston, IL (US)

( * ) Notice: Subject to any disclaimer, the term of this patent is extended or adjusted under 35 U.S.C. 154(b) by 720 days.

(21) Appl. No.: 12/937,348

(22) PCT Filed: Apr. 13, 2009

(86) PCT No.: PCT/US2009/040351

§ 371 (c)(1),
(2), (4) Date: Nov. 29, 2010

(87) PCT Pub. No.: WO2009/126954

PCT Pub. Date: Oct. 15, 2009

(65) Prior Publication Data

US 2011/0094637 A1 Apr. 28, 2011

Related U.S. Application Data

(60) Provisional application No. 61/044,355, filed on Apr. 11, 2008.

(51) Int. Cl.

| | |
|---|---|
| ***C22C 38/20*** | (2006.01) |
| ***C22C 38/44*** | (2006.01) |
| ***C22C 38/42*** | (2006.01) |
| ***C22C 38/46*** | (2006.01) |

(52) U.S. Cl.

CPC ..... *C22C 38/44* (2013.01); *C22C 38/20* (2013.01); *C22C 38/42* (2013.01); *C22C 38/46* (2013.01)

USPC ..... 148/318; 148/325; 148/326; 148/327; 420/56; 420/57; 420/58; 420/60; 420/61

(58) Field of Classification Search

USPC ..... 148/318, 325, 326, 327; 420/56–58, 420/60–61

See application file for complete search history.

(56) References Cited

U.S. PATENT DOCUMENTS 2,797,993 A * 7/1957 Tanczyn ..... 420/42
4,434,006 A * 2/1984 Kato et al. ..... 420/11

(Continued)

FOREIGN PATENT DOCUMENTS

EP 0607263 B1 12/1999
GB 2179675 A * 3/1987

(Continued)

OTHER PUBLICATIONS

International Preliminary Report on Patentability for PCT Application No. PCT/US2009/040351, mailed Oct. 21, 2010.
International Search Report and Written Opinion mailed Mar. 18, 2010 (PCT/US2009/040351); ISA/EP.

(Continued)

*Primary Examiner* — Sikyin Ip
(74) *Attorney, Agent, or Firm* — Banner & Witcoff, Ltd.

(57) ABSTRACT

A martensitic stainless steel alloy is strengthened by copper-nucleated nitride precipitates. The alloy includes, in combination by weight percent, about 10.0 to about 12.5 Cr, about 2.0 to about 7.5 Ni, up to about 17.0 Co, about 0.6 to about 1.5 Mo, about 0.5 to about 2.3 Cu, up to about 0.6 Mn, up to about 0.4 Si, about 0.05 to about 0.15 V, up to about 0.10 N, up to about 0.035 C, up to about 0.01 W, and the balance Fe and incidental elements and impurities. The nitride precipitates may be enriched by one or more transition metals.

10 Claims, 2 Drawing Sheets

(56) References Cited

U.S. PATENT DOCUMENTS

| | | | |
|---|---|---|---|
| 5,310,431 | A | 5/1994 | Buck et al. |
| 6,045,633 | A | 4/2000 | Henn et al. |
| 7,160,399 | B2 | 1/2007 | Keuhmann et al. |
| 7,235,212 | B2 | 6/2007 | Kuehmann et al. |
| 2003/0102057 | A1 | 6/2003 | Short |

FOREIGN PATENT DOCUMENTS

| | | | |
|---|---|---|---|
| WO | 03018856 | A2 | 3/2003 |
| WO | 2006068610 | A1 | 6/2006 |
| WO | 2006081401 | A2 | 8/2006 |

OTHER PUBLICATIONS

Ageev V S; Vil'Danova N F; Kozlov K A; Kochetkova T N; Nikitina A A; Sagaradze V V; Safronov B V; Tsvelev VV; Chukanov A P: "Structure and thermal creep of the oxide-dispersion-strengthened EP-450 reactor steel" Physics of Metals and Metallography Sep. 2008—Maik Nauka-Interperiodica Publishing, vol. 106, No. 3, Sep. 2008, pp. 318-325, XP002571196 RU ISSN: 0031-918X Doi: 10.1134/S0031918X08090123.

Frandsen R B et al: "Simultaneous surface engineering and bulk hardening of precipitation hardening stainless steel" Surface and Coatings Technology, Elsevier, Amsterdam, NL, vol. 200, No. 16-17, Apr. 27, 2006, pp. 5160-5169, XP024995358 ISSN: 0257-8972 Doi: 10.1016/j.surfcoat.2005.04.038 [retrieved on Apr. 27, 2006].

* cited by examiner

MARTENSITIC STAINLESS STEEL STRENGTHENED BY COPPER-NUCLEATED NITRIDE PRECIPITATES

CROSS-REFERENCE TO RELATED APPLICATION

The present application is a U.S. National Phase filing of International Application No. PCT/US2009/040351, filed Apr. 13, 2009, which claims priority to U.S. Provisional Patent Application No. 61/044,355, filed Apr. 11, 2008, both of which the present application claims priority to and the benefit of, and both of which are incorporated by reference herein in their entireties.

FEDERALLY SPONSORED RESEARCH AND DEVELOPMENT

This invention may be subject to governmental license rights pursuant to Marine Corps Systems Command Contract No. M67854-05-C-0025.

BACKGROUND

The material properties of secondary-hardened carbon stainless steels are often limited by cementite precipitation during aging. Because the cementite is enriched with alloying elements, it becomes more difficult to fully dissolve the cementite as the alloying content of elements such as chromium increases. Undissolved cementite in the steel can limit toughness, reduce strength by gettering carbon, and act as corrosion pitting sites.

Cementite precipitation could be substantially suppressed in stainless steels by substituting nitrogen for carbon. There are generally two ways of using nitrogen in stainless steels for strengthening: (1) solution-strengthening followed by cold work; or (2) precipitation strengthening. Cold worked alloys are not generally available in heavy cross-sections and are also not suitable for components requiring intricate machining Therefore, precipitation strengthening is often preferred to cold work. Precipitation strengthening is typically most effective when two criteria are met: (1) a large solubility temperature gradient in order to precipitate significant phase fraction during lower-temperature aging after a higher-temperature solution treatment, and (2) a fine-scale dispersion achieved by precipitates with lattice coherency to the matrix.

These two criteria are difficult to meet in conventional nitride-strengthened martensitic steels. The solubility of nitrogen is very low in the high-temperature bcc-ferrite matrix. And in austenitic steels, nitrides such as $M_2N$ are not coherent with the fcc matrix. Thus, there has developed a need for a martensitic steel strengthened by nitride precipitates.

BRIEF SUMMARY

Aspects of the present invention relate to a martensitic stainless steel strengthened by copper-nucleated nitride precipitates. According to some aspects, the steel substantially excludes cementite precipitation during aging. Cementite precipitation can significantly limit strength and toughness in the alloy.

According to other aspects, the steel of the present invention is suitable for casting techniques such as sand casting, because the solidification range is decreased, nitrogen bubbling can be substantially avoided during the solidification, and hot shortness can also be substantially avoided. For some applications, the steel can be produced using conventional low-pressure vacuum processing techniques known to persons skilled in the art. The steel can also be produced by processes such as high-temperature nitriding, powder metallurgy possibly employing hot isostatic pressing, and pressurized electro slag remelting.

According to another aspect, a martensitic stainless steel includes, in combination by weight percent, about 10.0 to about 12.5 Cr, about 2.0 to about 7.5 Ni, up to about 17.0 Co, about 0.6 to about 1.5 Mo, about 0.5 to about 2.3 Cu, up to about 0.6 Mn, up to about 0.4 Si, about 0.05 to about 0.15 V, up to about 0.10 N, up to about 0.035 C, up to about 0.01 W, and the balance Fe.

DETAILED DESCRIPTION

Figure 1:
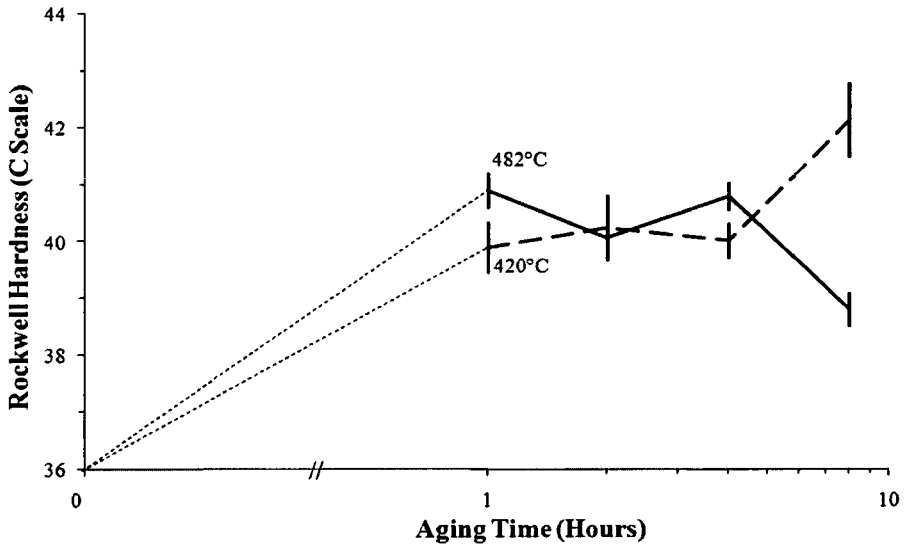
FIG. 1 is a graph illustrating the Rockwell C-scale hardness of an embodiment of an alloy according to the present invention, at specified aging conditions.

In one embodiment, a steel alloy includes, in combination by weight percent, about 10.0 to about 12.5 Cr, about 2.0 to about 7.5 Ni, up to about 17.0 Co, about 0.6 to about 1.5 Mo, about 0.5 to about 2.3 Cu, up to about 0.6 Mn, up to about 0.4 Si, about 0.05 to about 0.15 V, up to about 0.10 N, up to about 0.035 C, up to about 0.01 W, and the balance Fe and incidental elements and impurities. In another embodiment, the alloy includes, in combination by weight percent, about 10.0 to about 12.0 Cr, about 6.5 to about 7.5 Ni, up to about 4.0 Co, about 0.7 to about 1.3 Mo, about 0.5 to about 1.0 Cu, about 0.2 to about 0.6 Mn, about 0.1 to about 0.4 Si, about 0.05 to about 0.15 V, up to about 0.09 N, about 0.005 to about 0.035 C, and the balance Fe and incidental elements and impurities. In this embodiment, the content of cobalt is minimized below 4 wt % and an economic sand-casting process is employed, wherein the steel casting is poured in a sand mold, which can reduce the cost of producing the steel. It is understood that a greater amount of cobalt can be used in this embodiment. For example, secondary-hardened carbon stainless steels disclosed in U.S. Pat. Nos. 7,160,399 and 7,235,212, which are incorporated by reference herein and made part hereof, have a cobalt content up to about 17 weight percent. To establish a nitride-strengthened analogue of carbide-strengthened stainless steels, a cobalt content of up to about 17 weight percent may be utilized in this embodiment.

To be suitable for sand-casting, the solidification temperature range is minimized in this embodiment. During this solidification, nitrogen bubbling can be avoided by deliberately choosing the amount of alloying additions, such as chromium and manganese, to ensure a high solubility of nitrogen in the austenite. The very low solubility of nitrogen in bcc-ferrite phase can present an obstacle to the production of nitride-strengthened martensitic stainless steels. To overcome this challenge, one embodiment of the disclosed steel solidifies into fcc-austenite instead of bcc-ferrite, and further increases the solubility of nitrogen with the addition of chromium. The solidification temperature range and the desirable amount of chromium can be computed with thermodynamic database and calculation packages such as Thermo-Calc® software and the kinetic software DICTRA™ (DIffusion Controlled TRAnsformations) version 24 offered by Thermo-Calc Software. In another embodiment, the cast steel subsequently undergoes a hot isostatic pressing at 1204° C. and 15 ksi Ar for 4 hours to minimize porosity.

Compared to conventional nitride-strengthened steels, embodiments of the disclosed steel alloy have substantially increased strength and avoided embrittlement under impact loading. In one embodiment, the steel exhibits a tensile yield strength of about 1040 to 1360 MPa, an ultimate tensile strength of about 1210 to 1580 MPa, and an ambient impact toughness of at least about 10 ft·lb. In another embodiment, the steel exhibits an ultimate tensile strength of 1240 MPa (180 ksi) with an ambient impact toughness of 19 ft·lb. Upon quenching from a solution heat treatment, the steel transforms into a principally lath martensitic matrix. To this end, the martensite start temperature ($M_s$) is designed to be at least about 50° C. in one embodiment, and at least about 150° C. in another embodiment. During subsequent aging, a copper-based phase precipitates coherently. Nanoscale nitride precipitates enriched with transition metals such as chromium, molybdenum, and vanadium, then nucleate on these copper-based precipitates. In one embodiment, these nitride precipitates have a structure of $M_2N$, where M is a transition metal. Additionally, in this embodiment, the nitride precipitates have a hexagonal structure with two-dimensional coherency with the martensite matrix in the plane of the hexagonal structure. The hexagonal structure is not coherent with the martensite matrix in the direction normal to the hexagonal plane, which causes the nitride precipitates to grow in an elongated manner normal to the hexagonal plane in rod or column form. In one embodiment, the copper-based precipitates measure about 5 nm in diameter and may contain one or more additional alloying elements such as iron, nickel, chromium, cobalt, and/or manganese. These alloying elements may be present only in small amounts. The copper-based precipitates are coherent with the martensite matrix in this embodiment.

In one embodiment, high toughness can be achieved by controlling the nickel content of the matrix to ensure a ductile-to-brittle transition sufficiently below room temperature. The Ductile-to-Brittle Transition Temperature (DBTT) can be decreased by about 16° C. per each weight percent of nickel added to the steel. However, each weight percent of nickel added to the steel can also undesirably decrease the $M_s$ by about 28° C. Thus, to achieve a DBTT below room temperature while keeping the $M_s$ above about 50° C., the nickel content in one embodiment is about 6.5 to about 7.5 Ni by weight percent. This embodiment of the alloy shows a ductile-to-brittle transition at about −15° C. The toughness can be further enhanced by a fine dispersion of VN grain-refining particles that are soluble during homogenization and subsequently precipitate during forging.

The alloy may be subjected to various heat treatments to achieve the martensite structure and allow the copper-based precipitates and nitride precipitates to nucleate and grow. Such heat treatments may include hot isostatic pressing, a solutionizing heat treatment, and/or an aging heat treatment. In one embodiment, any heat treatment of the alloy is conducted in a manner that passes through the austenite phase and avoids formation of the ferrite phase. As described above, the ferrite phase has low nitrogen solubility, and can result in undissolved nitrogen escaping the alloy.

Table 1 lists various alloy compositions according to different embodiments of the invention. In various embodiments of the alloy described herein, the material can include a variance in the constituents in the range of plus or minus 5 percent of the stated value, which is signified using the term "about" in describing the composition. Table 1 discloses mean values for each of the listed alloy embodiments, and incorporates a variance of plus or minus 5 percent of each mean value therein. Additionally, an example is described below utilizing the alloy embodiment identified as Steel A in Table 1.

TABLE 1

| wt % | Fe | C | Co | Cr | Cu | Ni | Mo | Mn | N | Si | V | W |
|---|---|---|---|---|---|---|---|---|---|---|---|---|
| Steel A | Bal. | 0.015 | 3.0 | 11.0 | 0.8 | 7.0 | 1.0 | 0.5 | 0.08 | 0.3 | 0.1 | 0.01 |
| Steel B | Bal. | 0.015 | — | 12.5 | 1.9 | 2.0 | 0.7 | 0.5 | 0.10 | 0.3 | 0.1 | — |
| Steel C | Bal. | 0.015 | — | 11.0 | 2.3 | 2.0 | 0.6 | 0.5 | 0.08 | 0.3 | 0.1 | — |
| Steel D | Bal. | 0.015 | — | 12.5 | 1.9 | 3.0 | 1.5 | 0.5 | 0.10 | 0.3 | 0.1 | — |
| Steel E | Bal. | 0.015 | — | 11.0 | 0.8 | 6.2 | 1.0 | 0.5 | 0.08 | 0.3 | 0.1 | — |

Example 1

Steel A

Figure 2:
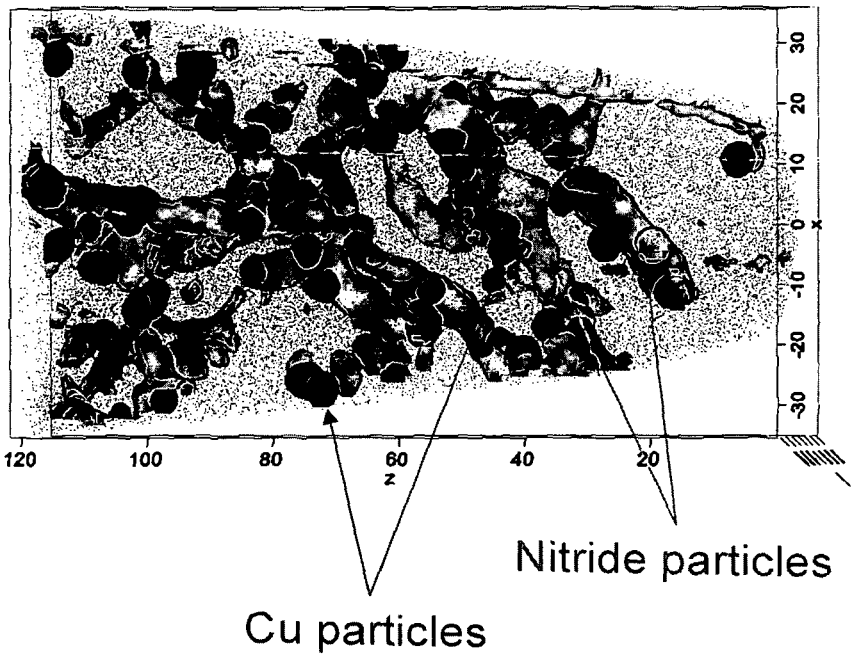
FIG. 2 is a 3-dimensional computer reconstruction of a microstructure of an embodiment of an alloy according to the present invention, produced using atom-probe tomography.

Steel A was sand cast, and nitrogen-bearing ferro-chrome was added during melt. The casting weighed about 600 pounds. The $M_s$ for this steel was confirmed as 186° C. using dilatometry. The steel was subjected to a hot isostatic pressing at 1204° C. and 15 ksi Ar for 4 hours, solutionized at 875° C. for 1 hour, quenched with oil, immersed in liquid nitrogen for 2 hours, and warmed in air to room temperature. In the as-solutionized state, the hardness of Steel A was measured at about 36 on the Rockwell C scale. Samples of Steel A were then subjected to an isothermal aging heat treatment at temperatures between 420 and 496° C. for 2 to 32 hours. As shown in FIG. 1, tests performed after the isothermal aging showed that the hardness of the alloy increases rapidly during the isothermal aging process and remains essentially constant at all subsequent times examined. The testing also showed that aging at 482° C. results in a higher impact toughness. Aging the invented steel at 482° C. for 4 hours resulted in a desirable combination of strength and toughness for the alloy evaluated. The tensile yield strength in this condition was about 1040 to 1060 MPa (151 to 154 ksi) and ultimate tensile strength was about 1210 to 1230 MPa (176 to 179 ksi). The ambient impact toughness in this condition was about 19 ft·lb, and the ductile-to-brittle transition was at about −15° C. FIG. 2 shows an atom-probe tomography of this condition where rod-shaped nitride precipitates nucleate on spherical copper-base precipitates.

The various embodiments of martensitic stainless steels disclosed herein provide benefits and advantages over existing steels, including existing secondary-hardened carbon stainless steels or conventional nitride-strengthened steels. For example, the disclosed steels provide a substantially increased strength and avoid embrittlement under impact loading, at attractively low material and process costs. Additionally, cementite formation in the alloy is minimized or substantially eliminated, which avoids undesirable properties that can be created by cementite formation. Accordingly, the disclosed stainless steels may be suitable for gear wheels where high strength and toughness are desirable to improve power transmission. Other benefits and advantages are readily recognizable to those skilled in the art.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. "Providing" an alloy, as used herein, refers broadly to making the alloy, or a sample thereof, available or accessible for future actions to be performed thereon, and does not connote that the party providing the alloy has manufactured, produced, or supplied the alloy or that the party providing the alloy has ownership or control of the alloy. It is further understood that the invention may be in other specific forms without departing from the spirit or central characteristics thereof. The present examples therefore are to be considered in all respects as illustrative and not restrictive, and the invention is not to be limited to the details given herein. Accordingly, while the specific examples have been illustrated and described, numerous modifications come to mind without significantly departing from the spirit of the invention and the scope of protection is only limited by the scope of the accompanying claims.

What is claimed is:

1. A martensitic stainless steel alloy strengthened by copper-nucleated nitride precipitates, said alloy comprising, in combination by weight percent, about 10.0 to about 12.5 Cr, about 2.0 to about 7.5 Ni, up to about 17.0 Co, about 0.6 to about 1.5 Mo, about 0.5 to about 2.3 Cu, up to about 0.6 Mn, up to about 0.4 Si, about 0.05 to about 0.15 V, [N] up to about 0.10 N, [C] up to about 0.035 C, up to about 0.01 W, and the balance Fe and incidental elements and impurities, said alloy having a microstructure substantially absent cementite [carbides] and comprising a martensite matrix with nanoscale copper particles and alloy nitride precipitates selected from the group consisting of alloy nitride precipitates enriched with a transition metal nucleated on the copper precipitates, alloy nitride precipitates having a hexagonal structure, alloy nitride precipitates including one or more alloying elements selected from [the group]Fe, Ni, Cr, Co and Mn coherent with the matrix, and alloy nitride precipitates having two dimensional coherency with the matrix said alloy substantially free of cementite [carbide] precipitates.

2. The alloy of claim 1, wherein the alloy comprises, in combination by weight percent, about 10.0 to about 12.0 Cr, about 6.5 to about 7.5 Ni, up to about 4.0 Co, about 0.7 to about 1.3 Mo, about 0.5 to about 1.0 Cu, about 0.2 to about 0.6 Mn, about 0.1 to about 0.4 Si, about 0.05 to about 0.15 V, [N] up to about 0.09 N, [C] about 0.005 to about 0.035 C, and the balance Fe and incidental elements and impurities.

3. The alloy of claim 1, wherein the alloy comprises, in combination by weight percent, about 11.0 Cr, about 7.0 Ni, about 3.0 Co, about 1.0 Mo, about 0.8 Cu, about 0.5 Mn, about 0.3 Si, about 0.1 V, about 0.08 N, about 0.015 C, about 0.01 W, and the balance Fe and incidental elements and impurities.

4. The alloy of claim 1, wherein the alloy has a tensile yield strength of about 1040 to 1360 MPa.

5. The alloy of claim 1, wherein the alloy has an ultimate tensile strength of about 1210 to 1580 MPa.

6. The alloy of claim 1, wherein the alloy has an ambient impact toughness of at least about 10 ft·lb.

7. The alloy of claim 1, wherein the alloy has a martensite start temperature of at least about 50° C.

8. The alloy of claim 1, wherein the alloy has a ductile to brittle transition temperature below about 20° C.

9. The alloy of claim 1, wherein the alloy comprises precipitates of a copper-based phase and nitride precipitates enriched with transition metals.

10. The alloy of claim 9, wherein the nitride precipitates nucleate on the copper-based phase, and comprise at least one metal selected from [a] the group consisting of: chromium, molybdenum, and vanadium.

* * * * *